US009359857B2

(12) United States Patent
O'Malley

(10) Patent No.: US 9,359,857 B2
(45) Date of Patent: Jun. 7, 2016

(54) SETTING ASSEMBLY AND METHOD THEREOF

(71) Applicant: Edward J. O'Malley, Houston, TX (US)

(72) Inventor: Edward J. O'Malley, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 392 days.

(21) Appl. No.: 13/945,092

(22) Filed: Jul. 18, 2013

(65) Prior Publication Data

US 2015/0021041 A1 Jan. 22, 2015

(51) Int. Cl.
*E21B 33/124* (2006.01)
*E21B 33/128* (2006.01)

(52) U.S. Cl.
CPC ..... *E21B 33/124* (2013.01); *E21B 33/128* (2013.01); *E21B 33/1243* (2013.01)

(58) Field of Classification Search
CPC ..... E21B 34/102; E21B 43/12
USPC ..... 166/187, 250.15, 373, 334.4, 66.7, 179, 166/207, 384, 386, 387, 190
See application file for complete search history.

(56) References Cited

U.S. PATENT DOCUMENTS 3,437,142 A 4/1969 Conover
5,505,706 A 4/1996 Maus et al.
7,604,062 B2 10/2009 Murray
7,828,068 B2 11/2010 Gano et al.
2004/0261990 A1 12/2004 Bosma et al.
2007/0199693 A1* 8/2007 Kunz ..... E21B 33/128 166/179
2007/0221387 A1 9/2007 Levy
2007/0284118 A1 12/2007 Benton et al.
2011/0083861 A1 4/2011 Allison et al.
2015/0218903 A1* 8/2015 Sellers, Jr. ..... F16J 15/164 166/380

OTHER PUBLICATIONS

"Thermal Actuator Technical Data", Thermal Actuators—Control Through Thermal Expansion, dated 2010, pp. 1-3.

International Search Report and Written Opinion for related PCT Application No. PCT/US2014/042924, dated Oct. 28, 2014, pp. 1-15.

* cited by examiner

*Primary Examiner* — David Bagnell
*Assistant Examiner* — Manuel C Portocarrero
(74) *Attorney, Agent, or Firm* — Cantor Colburn LLP

(57) ABSTRACT

A setting assembly including a settable member. A housing including a chamber and a setting material disposed in the chamber and having a first phase of matter and a second phase of matter. The setting material occupying a greater volume in the second phase than in the first phase. The setting material arranged to exert a setting force on the settable member during transition of the setting material from the first phase to the second phase. Also included is a method of setting a settable member.

13 Claims, 4 Drawing Sheets

SETTING ASSEMBLY AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. It is often necessary to isolate a zone within the borehole or within a tubular structure within the borehole, such as a casing or tubing string. Zone isolation is typically performed using packers which perform well for such a purpose. The packer is typically a flexible, elastomeric device that has a smaller initial outside diameter that then expands externally to seal to the borehole or outer tubing, thus separating the annulus between a tubular that supports the packer and the borehole or outer tubing into separate zones. Packers may be set through inflation or compression and are useful in both production and injection operations where zone isolation is useful. Some packers are also re-settable allowing for multiple uses and trips within the borehole.

One situation in which zonal isolation is useful is steam assisted gravity drainage ("SAGD"). SAGD is a process for the recovery of heavy oil in which two parallel adjacent horizontal boreholes are drilled in a formation. The upper borehole (an injection well) injects steam to the formation and reduces the viscosity of the heavy crude oil or bitumen, allowing it to flow down to the lower borehole (a production well) that collects the heated crude oil or bitumen.

The art would be receptive to alternative devices and methods for isolation within a borehole, as well as alternative devices and methods useful in SAGD.

SUMMARY

A setting assembly comprising a settable member; a housing including a chamber; and, a setting material disposed in the chamber and having a first phase of matter and a second phase of matter, the setting material occupying a greater volume in the second phase than in the first phase, the setting material arranged to exert a setting force on the settable member during transition of the setting material from the first phase to the second phase.

A method of setting a settable member, the method comprising enclosing a phase changeable setting material within a chamber of a housing in a solid state; heating the setting material to melt the setting material to a liquid state to expand a volume of the setting material; and harnessing the expansion of the setting material as a setting force to set the settable member.

BRIEF DESCRIPTION OF THE DRAWINGS

Referring now to the drawings wherein like elements are numbered alike in the several Figures.

DETAILED DESCRIPTION

Figure 1:
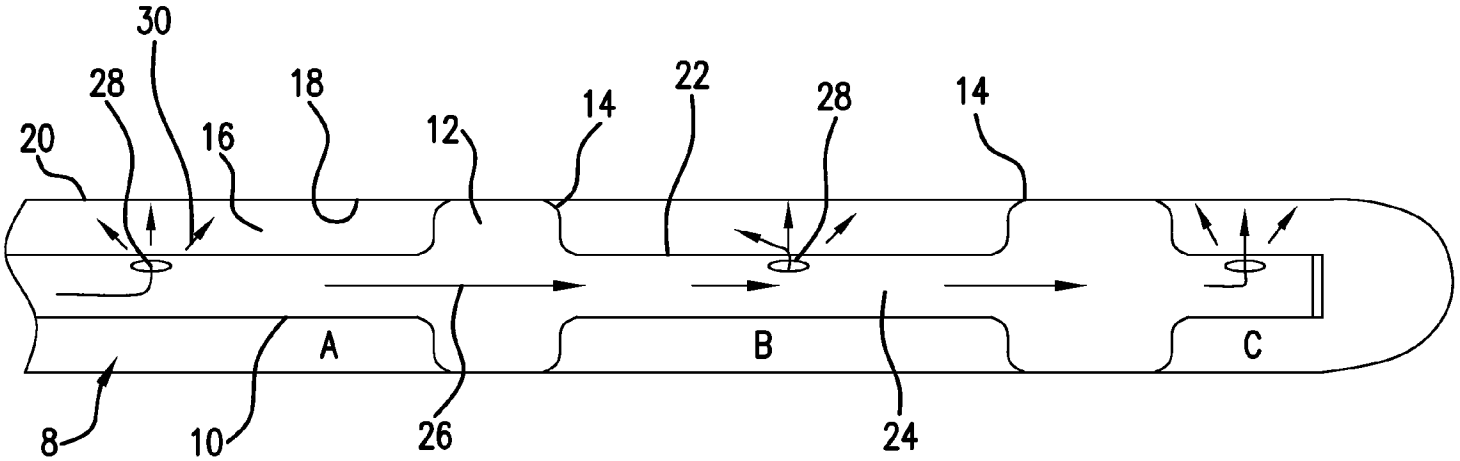
FIG. 1 shows a cross-sectional view of an exemplary embodiment of a downhole tool having a setting assembly using packers.

FIG. 1 shows an exemplary embodiment of a downhole tool 8 including a setting assembly 10. The setting assembly 10 is thermally energized due to the inclusion of a settable member 12 being settable and unsettable in response to thermal conditions. The setting assembly 10 includes at least one settable member 12 which has a set condition which is distinct from the initial condition. In the illustrated embodiment of FIG. 1, the settable member includes first and second packers 14. The set condition of the packers 14 is the expanded condition shown in FIG. 1. The packers 14 in the expanded condition divide an annulus 16 between the formation wall 18 of a borehole 20 and a tubular structure 22 of the downhole tool 8 into three exemplary zones A, B, and C. The downhole tool 8 may be provided within an open borehole 20 for a SAGD process, however the downhole tool 8 may alternatively be provided within a cased borehole or other tubular. Also, while two packers 14 are shown, it should be understood that any number of packers 14 may be employed with the downhole tool 8. The downhole tool 8 includes a longitudinally extending flowpath 24 useful for the injection of steam 26, as indicated by the arrows. The tubular structure 22 includes apertures 28 that allow the injected steam 26 to escape the tool 8 in a radial direction and into the annulus 16, as indicated by arrows 30. Because the packers 14 are in their expanded condition, the steam injected in Zone A is at least substantially separated from steam injected in Zone B, which is at least substantially separated from steam injected in Zone C.

Figure 2:
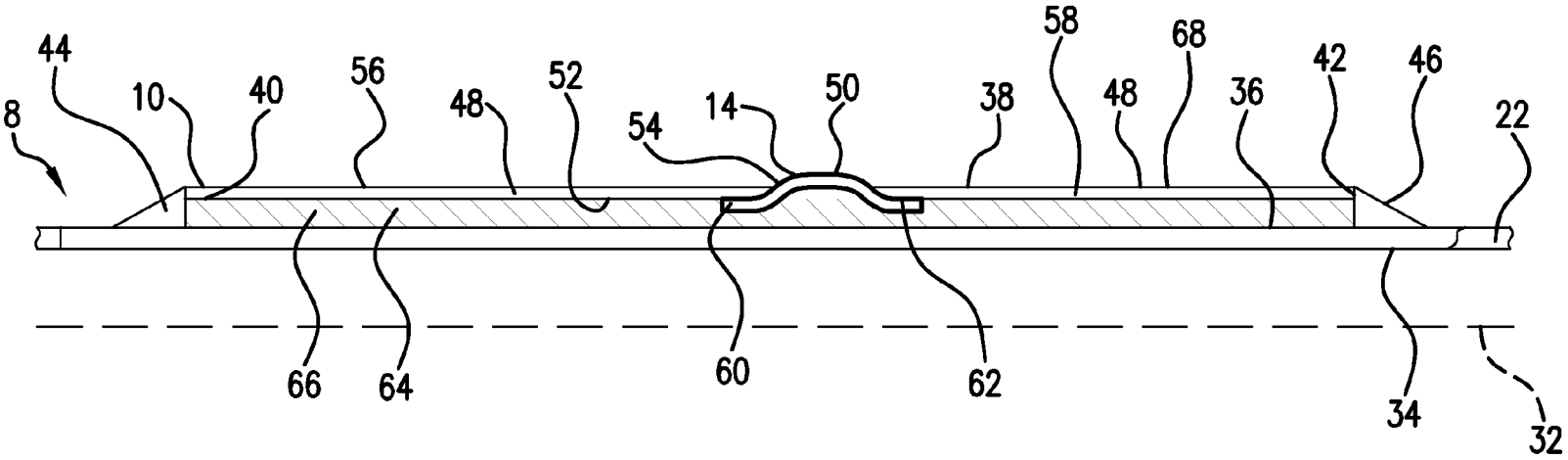
FIG. 2 shows a partial cross-sectional view of an exemplary embodiment of the setting assembly of FIG. 1 with the packer in an unset condition.

Turning to FIG. 2, the setting assembly 10 is shown in an initial or un-set condition with the packer 14 in the non-expanded state. The longitudinal axis 32 of the downhole tool 8 is depicted, and therefore it should be understood that only one half of the cross-section of the downhole tool 8 is illustrated in FIG. 2. The tubular structure 22 extends to, is continuous with, or otherwise includes a tubular shaped mandrel 34. While the mandrel 34 itself is shown as a one-piece unit such as a solid pipe, alternate embodiments of the setting assembly 10 may include two or more sections of tubulars, such as threaded pipes, screwed or otherwise secured together to serve as the mandrel 34. The mandrel 34 has an exterior surface 36 defining an outer diameter of the mandrel 34. Exterior to the mandrel 34 is an outer section 38 that at least substantially radially surrounds the mandrel 34. The outer section 38 is affixed to the mandrel 34 at first and second ends 40, 42 thereof either directly or via first and second connecting members 44, 46. The remainder of the outer section 38 includes an interior surface 52 that is positioned in a spaced relation with respect to the mandrel 34. The outer section 38 includes a rigid portion 48 and a flexible portion 50. In the exemplary embodiment shown, the rigid portion 48 includes an aperture 54, such as a cylindrically shaped aperture, and the flexible portion 50 spans the aperture 54 from a first section 56 of the rigid portion 48 to a second section 58 of the rigid portion 48. The flexible portion 50, which is also tubular, may include first and second ends 60, 62 that are overlapped by the first and second sections 56, 58 of the rigid portion 48 and may be elastomeric to have a stretched and unstretched condition. The interior surface 52 of the outer section 38, at least along the rigid portion 48, defines an interior diameter that is greater than the outer diameter of the mandrel 34 and the area between the mandrel 34 and the outer section 38 encloses a chamber 64 to secure a variable volume, phase changeable material 66 therein which is changeable between different states of matter. The mandrel 34, outer section 38, and connecting portions 44, 46 if used, together form a housing 68 that defines the chamber 64.

The material 66 is changeable between different states of matter. Each distinct form is called a phase. A solid has a definite shape and volume, while a liquid has a definite volume but takes the shape of a container. In an exemplary embodiment of the setting assembly 10, the variable volume, phase changeable material 66 is or at least includes paraffin. Paraffin expands up to 20% by volume when changing (melting) from a solid state phase to a liquid state phase. While paraffin alone is usable as the paraffin material 66, the paraffin material 66 can alternatively include other components in addition to paraffin to vary the melting point of the paraffin material 66. Alternatively, the paraffin itself can be selected to have the melting point qualities suitable for a particular operation. The paraffin may be selected to remain solid at ambient downhole conditions, but to melt at temperatures expected during thermal injection operations.

Figure 3:
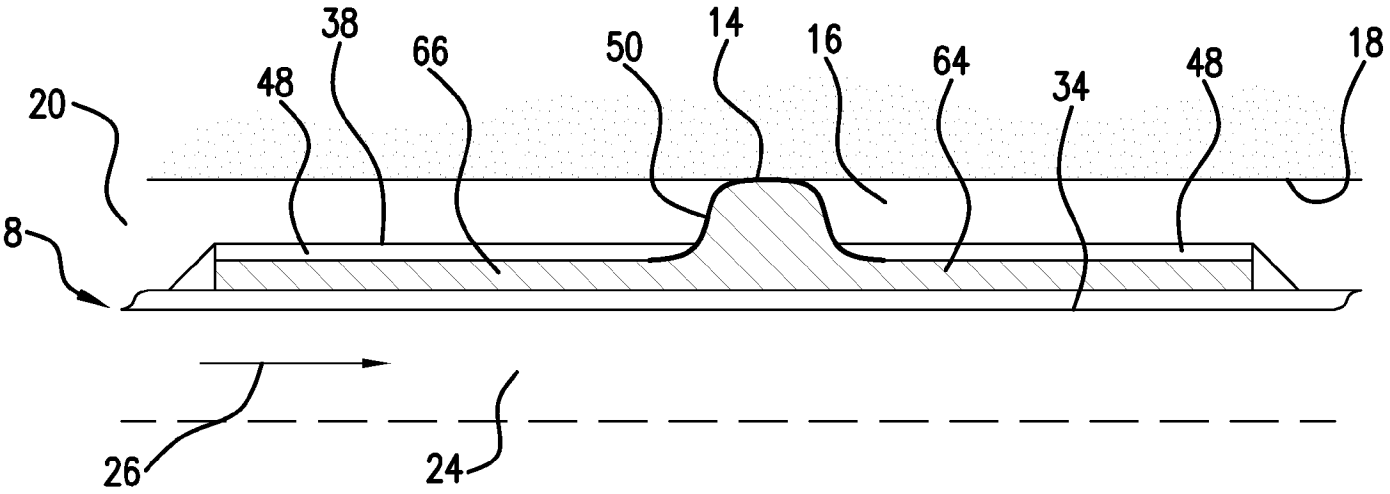
FIG. 3 shows a partial cross-sectional view of an exemplary embodiment of the setting assembly of FIG. 1 with the packer in a set condition.

In use, the downhole tool 8 having the setting assembly 10 is run downhole to a selected position within borehole 20. During this process, the packer 14 is in a non-expanded condition shown in FIG. 2. The paraffin material 66 is in a solid state due to the ambient temperature near the surface and of the downhole environment being such that the paraffin material 66 remains in a solid state, or at least substantially in a solid state, such that the flexible portion 50 remains non-expanded. With reference to FIG. 3, when the downhole tool 8 reaches a selected location within the borehole 20, and when the environment of the downhole tool 8 experiences an increase in temperature, such as via the injection of steam 26 through the flowpath 24 of the downhole tool 8 in a SAGD operation, the paraffin material 66 melts and increases in volume. Because the mandrel 34 and the rigid portion 48 are not expandable, the flexible portion 50 is forced to expand radially outwardly to accommodate the increased volume of the paraffin material 66 within the chamber 64. The flexible portion 50 expands to fill the width of the annulus 16 from the outer section 38 to the formation wall 18 in the expanded condition shown in FIG. 3. The chamber 64 is sized such that the flexible portion 50 of outer section 38 will be "inflated" due to the thermal expansion of the paraffin material 66 upon melting. The inflation will be to an extent that the formation wall 18 will be contacted with some pressure and a seal effected. In the inflated state, the tool 8 acts to compartmentalize a section of the well during thermal injection, such as in SAGD wells. When thermal injection ceases, the borehole 20 will cool and the paraffin will contract and solidify. That is, when the heat is removed, such as by the cessation of steam injection, the paraffin material 66 will begin to solidify and reduce in volume allowing the flexible portion 50 to retract from the formation wall 18 in order to either allow zones A, B, and C to have fluidic communication, remove the downhole tool 8 from the borehole 20, or reposition the downhole tool 8 as desired. By utilizing the heat from injected steam 26 to set the packers 14, no additional equipment is required to set or unset the packers 14, and thus there is no risk of such equipment becoming damaged in the SAGD operation.

Figure 4:
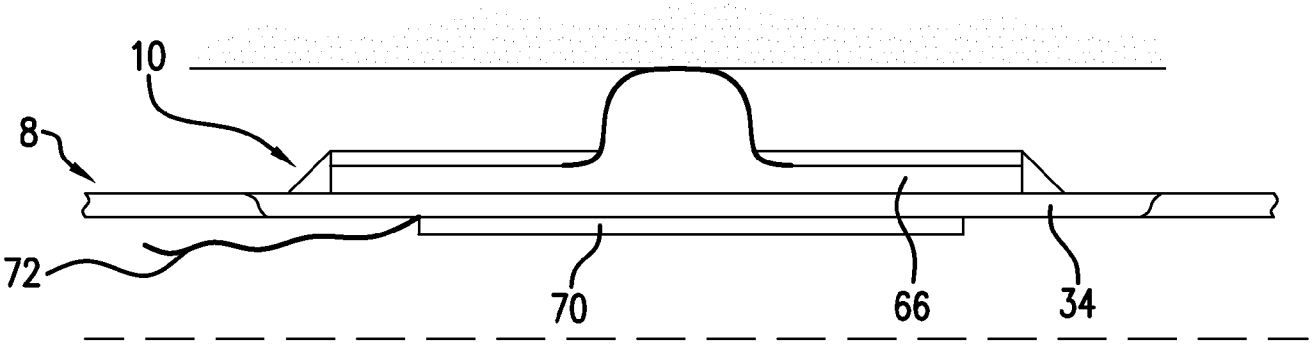
FIG. 4 shows a partial cross-sectional view of another exemplary embodiment of the setting assembly of FIG. 1 with the packer in a set condition.

While the above described embodiment advantageously utilizes the heat from injected steam 26 to set the packers 14, in an alternative exemplary embodiment illustrated in FIG. 4, a heating member 70 is incorporated in the downhole tool 8 to selectively heat the paraffin material 66 when desired. The heating member 70 may take the form of a tubular member, coiled member, or any other shape capable of conducting heat to the chamber 64 and paraffin material 66. While the heating member is illustrated as positioned adjacent the setting assembly 10 and along the mandrel 34, it could alternatively be positioned anywhere within or along the downhole tool 8 in a location that conducts heat towards the material 66. The heating of the heating member 70 may be operated from the surface via a control line 72.

Figure 5:
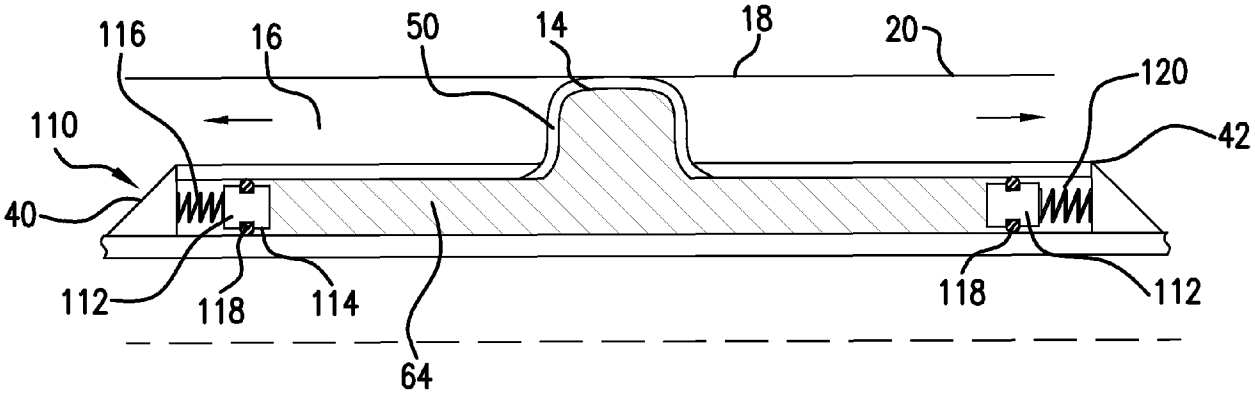
FIG. 5 shows a partial cross-sectional view of another exemplary embodiment of the setting assembly of FIG. 1 with the packer in a set condition.

FIG. 5 shows another alternate embodiment of a setting assembly 110. The setting assembly 110 is substantially the same as the setting assembly 10 of FIGS. 2-4 except for the inclusion of pressure relief members 112 provided within the chamber 64 to protect the flexible portion 50 from rupturing due to excess heat or a smaller than expected diameter of the borehole 20 or width of the annulus 16. An exemplary embodiment of the pressure relief member 112 includes a movable block 114 and spring 116. The movable block 114 may be substantially ring-shaped to fill a cross-section of the chamber 64, and to separate an area of the chamber 64 filled with the material 66 from an area 120 of the chamber 64 not filled with the material 66. The movable block 114 is sealed to the interior of the chamber 64, such as via O-ring 118 to prevent the material 66 from entering area 120. While first and second pressure relief members 112 are provided at the first and second ends 40, 42 of the setting assembly 110, respectively, it would also be within the scope of these embodiments to provide a single pressure relief member 112. The pressure relief members 112 are biased away from the first and second ends 40, 42 of the setting assembly 112, respectively. The spring force of the spring 116 and the flexibility of the flexible portion 50 are such that the bias of the spring 116 cannot be overcome by the volume expansion of the material 66 until after the flexible portion 50 has been expanded. In other words, it requires less force to expand the flexible portion 50 to the formation wall 18 than it does to compress the spring 116. After the temperature rises and the flexible portion 50 expands, the flexible portion 50 protected from rupturing due to overheating or overexpansion because the increasing volume (beyond what is required by the expansion of the flexible portion 50) is absorbed by the pressure relief member(s) 112. That is, when the flexible portion 50 can no longer expand, the increasing volume presses the block 114 towards the respective first or second end 40, 42 by compressing the spring 116 in the directions 122, 124, respectively, as indicated by the arrows to accommodate the increased volume and thus prevent the rupturing of the flexible portion 50.

Figure 6:
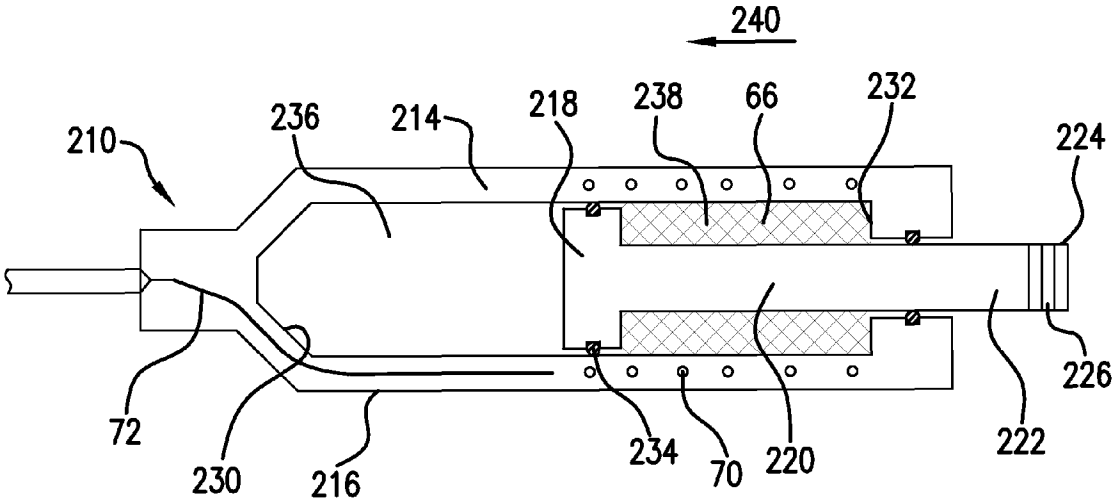
FIG. 6 shows a cross-sectional view of another exemplary embodiment of a setting assembly; and, FIG. 7 shows a cross-sectional view of another exemplary embodiment of a downhole tool having a setting assembly using packers.

While FIGS. 2-5 illustrate a setting assembly 10 in which the settable members 12 are packers 14 which are set through inflation, the setting assembly 10 may alternatively include compression set packers as the settable member 12. A compression set packer expands in response to compression of an elastomeric material of the packer, forcing the sides of the packer to bulge radially outwardly. FIG. 6 shows one exemplary embodiment of a setting assembly 210 usable in conjunction with a compression set packer 212, shown in FIG. 7. In an exemplary embodiment, the setting assembly 210 includes a wireline pressure setting assembly ("WLPSA") 214 that may be employed to ensure the successful setting of one or more settable members such as, but not limited to, bridge plugs, retainer production packers, and cement retainers. While a prior WLPSA builds up pressure through the products of combustion, the setting assembly 210 uses the variable volume, phase changeable material 66, such as paraffin material, sealed therein to build up the pressure necessary to set the settable member. The setting assembly 210 includes an enclosed tubular housing 216 containing a piston head 218 of a piston 220 therein. A piston rod 222 of the piston 220 extends from the piston head 218 and then exteriorly of the enclosed housing 216. The piston rod 222 includes an engagement feature 224 that engages with either the settable member, a cooperating feature that engages with the engagement feature to set the settable member, or another engagement feature that engages with the settable member or cooperating feature. In an exemplary embodiment, the piston rod 222 includes a threaded end 226 and may connect with a variety of potential engagement features thereon. In an exemplary embodiment of a setting assembly 210 for a compression packer 212, the cooperating feature is a compressing member 228 such that movement of the piston 220 translates to movement of the compressing member 228. The compressing member 228 is configured to be capable of compressing the compression packer 212, and therefore may be substantially ring shaped, however it may include apertures, petals, or be foldable as necessary. The piston 220 is longitudinally moveable between a first end 230 of an interior of the housing 216 and a second end 232 of the interior of the housing 216. The piston head 218 is disposed between the first and second ends 230, 232 and a seal, such as O-ring 234 may be secured around the piston head 218 to separate a first area 236 between the piston head 218 and the first end 230 from a second area 238 between the piston head 218 and the second end 232. The second area 238 is filled with the material 66. The first area 236 may include a spring (not shown) or other biasing member that biases the piston head 218 towards the second end 232 to return to its initial position after removal of heat. In normal surface or ambient temperatures, the piston rod 222 will be in a position such that the compressing member 228, or other cooperating feature, does not compress the compression packer 212, or otherwise set the settable member. However, upon application of heat, such as injection of steam 26 shown in FIG. 7 or via a control line 72 and heatable member 70 shown in FIG. 6, the material 66 will begin to melt and expand in volume as previously described. Volume expansion of the paraffin material 66 pushes the piston head 218 towards the first end 230, which in turn pulls the piston rod in direction 240, as well as the compressing member 228 in direction 240. Movement of the compressing member 228 in direction 240 compresses the packer 212 between the compressing member 228 and another plate or compressing member 242.

Figure 7:
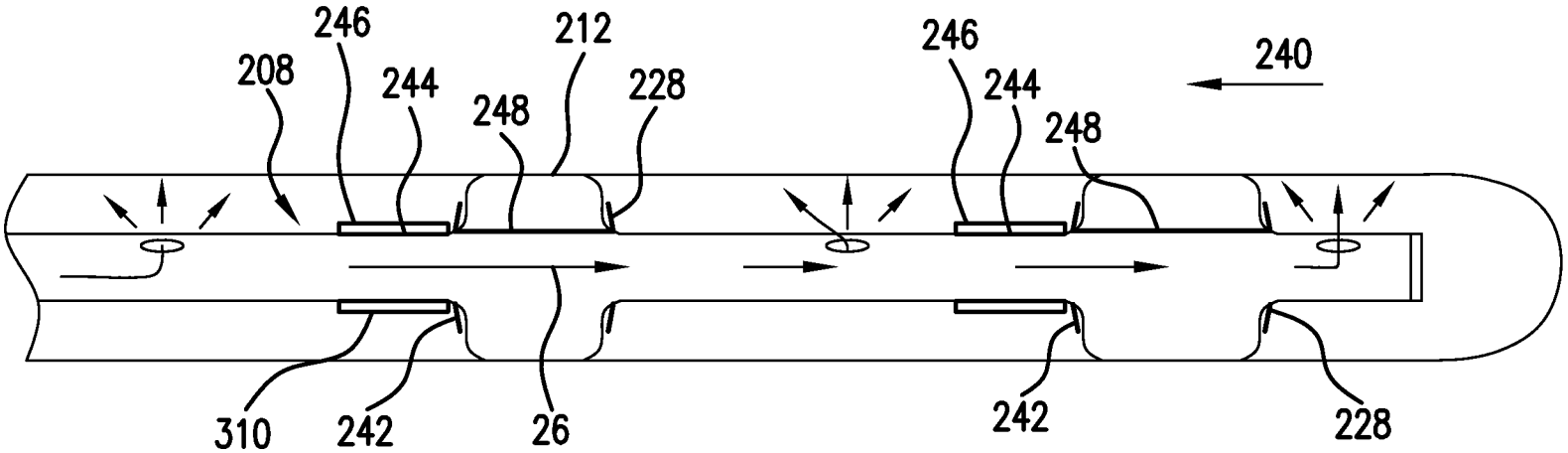

While FIG. 6 demonstrates a wireline operation of the setting assembly 210, an alternate exemplary embodiment incorporating the material 66 to move a piston could also be configured to encircle the downhole tool 208, such as shown in FIG. 7. In such an embodiment, the piston head 244 would be substantially ring shaped, as would the surrounding housing 246. The piston rod 248 need not be ring shaped, so long as the connection to compressing member 228 is sufficient to pull the compressing member 228 in direction 240 without damage. Also, while FIG. 7 illustrates a SAGD operation, application of heat may alternatively be accomplished via control line 72 and heating member 70. The compressing member 228 is positioned at one side of the compression packer 212 and a remainder of the setting assembly 310 is provided on an opposite side of the compression packer 212 in FIG. 7, however the setting assembly 310 could be alternatively arranged to accommodate varying settable members.

Thus, an isolation tool for wells using thermal injection (such as SAGD completions) has been described that uses a thermally energizable, phase and volume changeable material to deploy and energize a settable member, such as a packer, seal, or other settable member. A method of setting the settable member includes enclosing the phase changeable setting material within a chamber of a housing in a solid state, heating the setting material to melt the setting material to a liquid state to expand a volume of the setting material, and harnessing the expansion of the setting material as a setting force to set the settable member.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A setting assembly comprising:

a settable member;

a housing including a chamber;

a piston including a piston head movably disposed within the chamber, and a piston rod connected to the piston head and extended exteriorly of the chamber, the piston head dividing the chamber into a first area and a second area; and, a setting material disposed in the second area of the chamber and restricted from the first area of the chamber by the piston head, the setting material having a first phase of matter and a second phase of matter, the setting material occupying a greater volume in the second phase than in the first phase, the setting material arranged to exert a force on the piston head to move the piston head within the chamber during transition of the setting material from the first phase to the second phase;

wherein movement of the piston rod effects setting and unsetting of the settable member.

2. The setting assembly of claim 1 wherein the first phase of the setting material is solid and the second phase is liquid.

3. The setting assembly of claim 1 wherein the settable member is a compression packer.

4. The setting assembly of claim 1 wherein the housing is arranged on a wireline device.

5. The setting assembly of claim 1 wherein the setting material is a paraffin material.

6. The setting assembly of claim 1 further comprising a heat source to transition the setting material from the first phase to the second phase.

7. The setting assembly of claim 6 wherein the heat source is steam from a steam assisted gravity drainage system.

8. The setting assembly of claim 6 wherein the heat source is a heating element adjacent the housing, the heating element selectively controlled by a control line.

9. The setting assembly of claim 1, wherein the piston rod includes a first end and an opposite second end, the first end connected to the piston head and the second end including an engagement feature.

10. A setting assembly of comprising;

a settable member;

a housing including a chamber;

a setting material disposed in the chamber and having a first phase of matter and a second phase of matter, the setting material occupying a greater volume in the second phase than in the first phase, the setting material arranged to exert a setting force on the settable member during transition of the setting material from the first phase to the second phase; and, a movable piston head within the chamber and dividing the chamber into a first area and a second area, the setting material disposed in the second area and restricted from the first area by the piston head, and a piston rod extending from the piston head and exteriorly of the chamber to effect setting and unsetting of the settable member, wherein transition of the setting material from the first phase to the second phase moves the piston head.

11. A method of setting a settable member, the method comprising:

enclosing a phase changeable setting material within a chamber of a housing in a solid state, a piston head of a piston dividing the chamber into a first area and a second area, the setting material disposed in the second area and restricted from the first area by the piston head;

heating the setting material to melt the setting material to a liquid state to expand a volume of the setting material;

harnessing the expansion of the setting material as a setting force to move the piston head within the chamber; and, utilizing the piston rod of the piston to engage with and set the settable member.

12. The method of claim 11 wherein heating the setting material includes injecting steam into a steam assisted gravity drainage system.

13. A downhole system employable within a borehole, the downhole system including:

a tubular structure having a flow path; and, the setting assembly of claim 1, wherein the chamber is disposed exteriorly of the flow path.

* * * * *